United States Patent [19]

Kondoh

[11] Patent Number: 4,566,776

[45] Date of Patent: Jan. 28, 1986

[54] MAGNETIC TONER DEVELOPING DEVICE

[75] Inventor: Shiroh Kondoh, Sagamihara, Japan

[73] Assignee: Ricoh Company, Ltd., Japan

[21] Appl. No.: 481,068

[22] Filed: Mar. 31, 1983

[30] Foreign Application Priority Data

Mar. 31, 1982 [JP] Japan ..... 57-50978
Mar. 31, 1982 [JP] Japan ..... 57-50979

[51] Int. Cl.[4] ..... G03G 15/09

[52] U.S. Cl. ..... 355/3 DD; 118/657; 118/652; 118/261

[58] Field of Search ..... 355/3 DD, 14 D, 15; 118/261, 657, 658, 652

[56] References Cited

U.S. PATENT DOCUMENTS 4,142,165 2/1979 Miyakawa et al. ..... 355/15 X
4,233,386 11/1980 Aizawa et al. ..... 15/1.5 R X
4,267,245 5/1981 Wada ..... 118/652 X
4,299,472 11/1981 Seelenbinder et al. ..... 118/261 X
4,316,428 2/1982 Flaum et al. ..... 118/261 X
4,348,979 9/1982 Daintrey ..... 355/3 DD X
4,364,656 12/1982 Yanagawa ..... 355/3 DD X
4,373,798 2/1983 Tsukada et al. ..... 355/3 DD
4,382,420 5/1983 Ohnuma et al. ..... 355/3 DD X
4,386,s577 6/1983 Hosono et al. ..... 118/261 X

*Primary Examiner*—Richard L. Moses
*Attorney, Agent, or Firm*—Guy W. Shoup

[57] ABSTRACT

A device for developing an electrostatic latent image formed on an imaging surface using electrically insulating and magnetically attractable toner particles includes a developing sleeve and a doctor blade for forming a film of toner particles on the sleeve. In one form, the doctor blade has an end surface which is inclined at an angle in the range 15°±15° with respect to the tangential plane defined at the point of contact where the tip end of the doctor blade meets with the sleeve surface, and this angle converges in the direction of the sleeve's direction of movement.

16 Claims, 14 Drawing Figures

MAGNETIC TONER DEVELOPING DEVICE

BACKGROUND OF THE INVENTION

1. Field of the Invention

This invention generally relates to a device for developing an electrostatic latent image formed on an imaging surface using toner particles to obtain a visual toner image, and, in particular, to a device for developing an electrostatic latent image using magnetic toner particles.

2. Description of the Prior Art

In electrophotographic copying and printing machines and facsimile machines or the like, an electrostatic latent image is formed on an imaging surface such as the surface of a photosensitive member, and, then, the thus formed latent image is developed by a developer, normally called toner, to obtain a visual toner image. A device for developing such a latent image using highly electrically resistive, magnetically attractive toner particles is well known in the art. However, this type of toner particles usually do not bear real charges, and, thefore, a bias potential is normally applied to a developing sleeve on which toner particles are carried. Thus when the toner particles are brought closer to the imaging surface on which an electrostatic latent image to be developed is formed, charges are induced in the toner particles under the influence of an electric field created between the developing sleeve and the latent image on the imaging surface whereby the induced charges in the toner particles are used to carry out development, i.e., attraction of toner particles to the latent image.

For this reason, in a prior art device for developing an electrostatic latent image using insulating and magnetic toner particles, requirements for the potential of an electrostatic latent image to be developed and for the bias potential to be applied to a developing sleeve have been rather severe. Another disadvantage in the prior art device is that when charges are induced as described above, electrically unstable toner particles may adhere to those portions of the imaging surface other than image portions, which could cause the so-called background contamination. In order to obviate such disadvantages, a trial has been made to lower the resistivity of toner particles; however, a reduction in resistivity would cause a deterioration in image transfer efficiency thereby bringing about another disadvantage. Thus there has been a need to develop a novel developing device capable of developing a latent image using electrically insulating, magnetic toner particles stably at all times.

SUMMARY OF THE INVENTION

It is a primary object of the present invention to provide an improved device for developing an electrostatic latent image using electrically insulating, magnetically attractable toner particles.

Another object of the present invention is to provide a device for developing an electrostatic latent image using insulating and magnetic toner particles stably at all times.

A further object of the present invention is to provide a device for developing an electrostatic latent image which is high in developing efficiency.

A still further object of the present invention is to provide a developing device capable of forming a thin layer of insulating and magnetic toner particles which are properly charged.

A still further object of the present invention is to provide a developing device capable of forming a thin layer of insulating and magnetic toner particles uniform in thickness at all times.

Other objects, advantages and novel features of the present invention will become apparent from the following detailed description of the invention when considered in conjunction with the accompanying drawings.

DESCRIPTION OF THE PREFERRED EMBODIMENT

Figure 1:
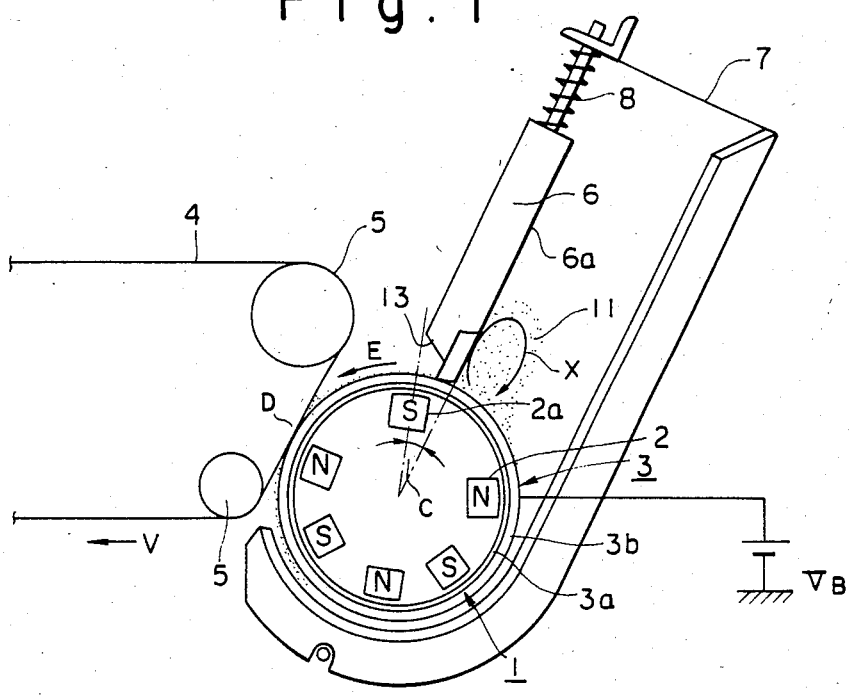
FIG. 1 is a schematic illustration showing one embodiment of the present developing device.

Referring now to FIG. 1, there is shown one embodiment of the present developing device 1 using electrically insulating and magnetically attractable toner particles 11 (hereinafter simply referred to as "magnetic toner particles") as a developer. As shown, the developing device 11 includes a developing sleeve 3 which is connected to a bias potential source $V_B$ and which is comprised of an electrically conductive sleeve 3*a* of a thin metal such as stainless steel and an electrically conductive rubber layer 3*b* integrally formed on the outer peripheral surface of the sleeve 3*a*. The conductive rubber layer 3*b* is formed by a rubber material having resistivity of $10^8$ ohms-cm or less, preferably $10^5$ ohms-cm or less, and rubber hardness of 50° or less, such as silicon rubber. Inside the sleeve 3 is disposed a magnetic roll 2 having a plurality of magnetic poles 2*a*, six poles in the illustrated embodiment. It is to be noted that the magnetic roll 2 may be fixedly provided, or alternatively it may be provided to be driven to rotate in a predetermined direction. Moreover, a plurality of magnets may be provided instead of a single magnetic roll having a plurality of magnetic poles.

The sleeve 3 is so disposed to have a portion which is closer to or in contact with an endless recording belt 4 extended around a pair of rolls 5, 5. The region where the sleeve 3 and the recording medium 4 are located closer or in contact and its surrounding is defined as a developing region D. Thus, the toner particles 11 carried on the peripheral surface of the sleeve 3 are applied to an electrostatic latent image formed on the recording medium 4 whereby the latent image is developed into a visible toner image where the outer peripheral surface of the sleeve 3 defines a path for transporting the toner particles 11 through the developing region D. The outer surface of the recording belt 4 which moves in the direction indicated by the arrow V, defines an imaging surface on which an electrostatic latent image may be formed in accordance with any of the well known image forming method. Thus, the belt may be so structured to include a photoconductive layer and an electrically conductive support layer on which the photoconductive layer is formed. Alternatively, the recording medium may be structured in the form of a drum as well known in the art.

The developing device also includes a doctor blade 6 disposed upstream of the developing region D with respect to the direction of rotation of the sleeve 3. The doctor blade 6 of this embodiment is generally rectangular in shape, and the plate-shaped doctor blade 6 is so disposed that the plane determined by the front surface 6*a* of the doctor blade 6 approximately includes the rotating axis of the sleeve 3. The doctor blade 6 is movably supported by a housing 7 of the present developing device and it is biased against the sleeve 3 by means of a spring 8 inserted between the housing 7 and the doctor blade 6. Thus, the toner particles 11 generally move in a circulatory manner in front of the doctor blade 6 as indicated by the arrow X when the sleeve 3 moves in the direction shown by arrow E. Importantly, an edge portion 6*b* is provided at the forward or bottom end of the doctor blade 6 having an inclined relief surface 13 as will be described in detail below. Incidentally, the edge portion 6*b* may be formed either as a portion of the doctor blade 6 or initially as a separate member which is then integrally combined with the doctor blade 6.

Figure 2:
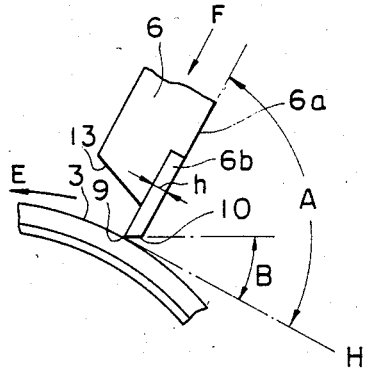
FIG. 2 is a schematic illustration showing on an enlarged scale the detailed structure of the end section of the doctor blade 6 employed in the developing device of FIG. 1.

As shown in FIG. 2, in the present embodiment, the edge portion 6*b* is initially formed as a separate member and it is fixedly attached to the forward end of the doctor blade 6. In the attached state, the front surface of the edge portion 6*b* is flush with the front surface 6*a* of the doctor blade 6. The edge portion 6*b* is thinner in thickness as compared with the doctor blade 6 and its thickness h is, for example, approximately 0.5±0.2 mm. The edge portion 6*b* has a rear surface, which is opposite to and generally in parallel with its front surface, and an inclined end face 10 which is opposite to the peripheral surface of the sleeve 3. Thus, a knife edge having an angle B is formed by the rear surface and inclined end face of the doctor blade 6. Preferably, the angle B formed between the tangential plane H including the contact line between the tip end 9 of the edge portion 6*b* and the peripheral surface of the sleeve 3 and the plane defined by the inclined end face 10 of the edge portion 6*b* is an acute angle, and, most preferable, the angle B is set at 15°±15°. Furthermore, it is preferable to set the angle A formed between the tangential plane including the contact line between the tip end 9 of the sleeve 3 and the front surface 6*a* of the doctor blade 6 at 90°±30°.

The magnetic toner particles 11 are attracted to the peripheral surface of the sleeve 3 due to the magnets 2 disposed inside of the sleeve 3, and as the sleeve 3 rotates, the thus attracted magnetic toner particles 11 are carried along the circular path defined by the periphery of the sleeve 3. However, when they come to the location where the doctor blade 6 is disposed, they are mostly prevented from being carried further and there will be formed stagnating toner particles 11 in front of the doctor blade 6. These stagnating toner particles 11 will circle around as indicated by the arrow X. On the other hand, some of the magnetic toner particles attracted to the peripheral surface of the sleeve 3 enter into the wedge-shaped entrance section defined between the inclined end face 10 and the peripheral surface of the sleeve 3. As the sleeve 3 rotates further, the toner particles which have entered the wedge-shaped entrance section are formed to move past the doctor blade 6 under pressure, and, therefore, while they move past the doctor blade 6 under pressure, they are triboelectrically charged due to friction with the doctor blade 6 and possibly with the sleeve 3.

Using toner particles having the average diameter of 10–20 microns and setting the pressing force F of the doctor blade 6 at 5 g/mm, a desirable thin film of toner particles having the thickness ranging between 40 and 60 microns has been obtained on the peripheral surface of the sleeve 3 past the doctor blade 6, and this toner film has been found to bear real charges with the specific charge amount of 10–15 micro-Coulombs/g. And the thus formed toner film is carried to the developing region D as the sleeve 3 rotates, and it is brought closer to or into contact with an electrostatic latent image formed on the recording belt 4 so that the latent image is developed into a visual toner image. Moreover, a bias potential $V_B$ is applied to the sleeve 3, or to the rubber sleeve 3*b* to be exact. Accordingly, the amount of toner particles to be deposited onto a latent image on the recording belt 4 largely depends upon such factors as the strength of electric field formed by the potential of the latent image and the bias potential of the sleeve 3, the specific charge amount of the toner particles forming a toner film, and the thickness of a toner film. The doctor blade 6 may be made of any desired material, either magnetic or non-magnetic, but a non-magnetic material is preferred in consideration of controllability in pressing force F. For example, a material such as stainless steel is preferred when wear is to be taken into account.

A doctor blade 6 of stainless steel is preferable from the viewpoint of formation of a thin film of toner particles and triboelectric charging; however, during a long time use, the inclined end face 10 will be worn due to friction with toner particles to become a flat end face which is in parallel with the opposed portion of the sleeve 3. This is disadvantageous because the absence of the above-mentioned wedge-shaped entrance section will tend to produce a thinner film of tonner particles past the doctor blade 6 thereby lowering the developing performance. Accordingly, in order to prevent the inclined end face 10 from being worn out due to friction against toner particles, it is preferable to have the doctor blade 6 or at least the edge portion 6*b* subjected to hardening treatment. For example, the edge portion 6*b* is subjected to nitriding treatment to make the surface layer of 0.1 mm hardened to have hardness H=1,100–1,400. Alternatively, the edge portion 6b may be hardened using ceramics. It has been found, however, that toner particles tend to agglomerate at the entrance side of the doctor blade 6 if the forward end or bottom portion of the doctor blade 6 has been subjected to hardening treatment and no such tendency to agglomerate is present if the front surface of the doctor blade 6 has been prevented from being subjected to hardening treatment. Thus, it is preferable to have only the inclined end face 10 subjected to hardening treatment so as to avoid attendant disadvantages such as agglomeration of toner particles.

It has been found that irregularities in the resulting thin film of toner particles may be eliminated by disposing the doctor blade 6 with respect to one magnetic pole of the magnet roll 2 such that the angle C formed between the front surface 6a of the doctor blade 6 and the straight line passing through the rotating axis of the sleeve 3 and the center of the magnetic pole, as shown in FIG. 1, is in the order of 10°. As shown in FIGS. 1–2, it is preferable to define the relief surface 13 at the forward or bottom end of the doctor blade 6, which is located substantially away from the peripheral surface of the sleeve 3 at the rear side of the edge portion 6b. With such a structure, deposition of toner particles to the doctor blade 6 may be effectively avoided.

Figure 3:
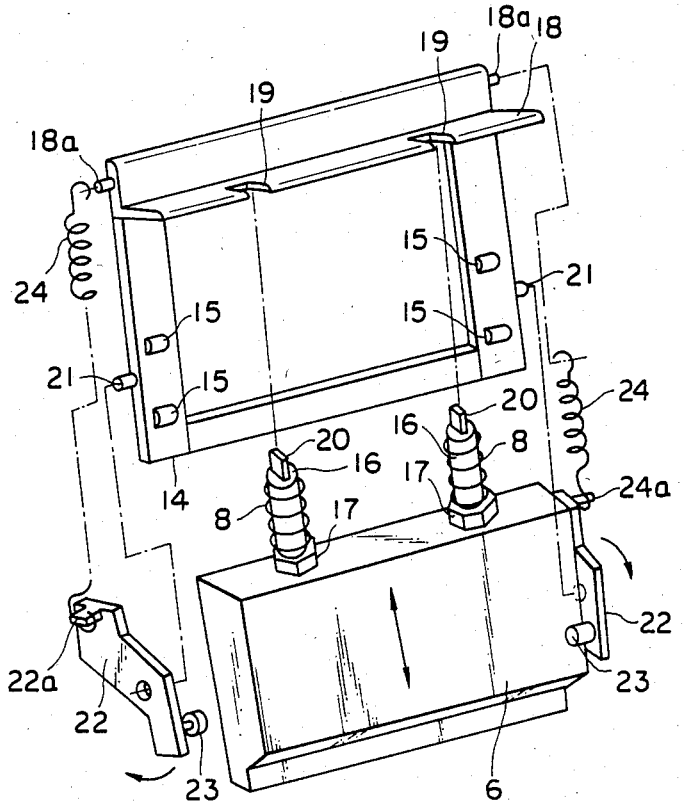
FIG. 3 is an exploded view showing in detail the supporting structure of the doctor blade employed in the developing device of FIG. 1.

As described above, in the embodiment of FIG. 1, the doctor blade 6 should be supported to be easily and smoothly movable against the sleeve 3 because it must be biased against the sleeve 3 by means of the spring 8 so as to form a desired thin film of toner particles on the peripheral surface of the sleeve 3. FIG. 3 shows the supporting structure to be applicable to the embodiment of FIG. 1 for this purpose. As shown in FIG. 3, On the housing 7 of the developing device 1 shown in FIG. 1 there is mounted a support frame 14 provided with a plurality of guide rollers 15 as shown in FIG. 3. And the doctor blade 6 is provided to be in rolling contact with these guide rollers 15. A pair of pins 16, 16 is threaded into the doctor blade 6 at its top and the spring 8 is fitted onto each of the pins 16, 16. In the illustrated embodiment, a nut 17 is screwed onto each of the threaded pins 16, 16 and thus the projecting length of the pins 16, 16 may be adjusted. If desired, the pins 16, 16 may be fixedly planted into the doctor blade 6. The free end of each of the pins 16, 16 is formed into a rectangularly shaped pawl 20 which may be fitted into a corresponding recess 19 provided in a support plate 18 which, in turn, is fixedly mounted on the housing 7 of the developing device 1.

With this structure, the doctor blade 6 may move freely as guided by the guide rollers 15 and thus the doctor blade 6 is pressed against the sleeve 3 by means of the springs 8, 8. This supporting structure is particularly advantageous because the doctor blade 6 may be easily mounted into or detached from the supporting structure (from the side where the recording belt 4 is located in FIG. 1), even though the doctor blade 6 is disposed in a narrow space. The support frame 14 is also provided with a pair of pins 21, 21 one in each opposite side of the frame 14, and a lever 22 is provided as pivotally supported by each of the pins 21, 21. A roller 23 is rotatably supported at the bottom end of the lever 22 and the roller 23 may be brought into engagement with the front surface of the doctor blade 6 when assembled thereby maintaining the doctor blade 6 in position. On the other hand, at the top end of the lever 22 is formed a projection 22a which is in engagement with one end of a spring 24 whose the other end is hooked to a pin 18a, extending from the support plate 18. Accordingly, the lever 22 is biased to pivot around the pin 21 such that the doctor blade 6 is kept pressed against the rollers 15. In this manner, the doctor blade 6 is maintained in a predetermined orientation as held between the rollers 15 and 23 and at the same time it can move along its longitudinal direction as indicated by the double-sided arrow in FIG. 3 without constraint.

Figure 4:
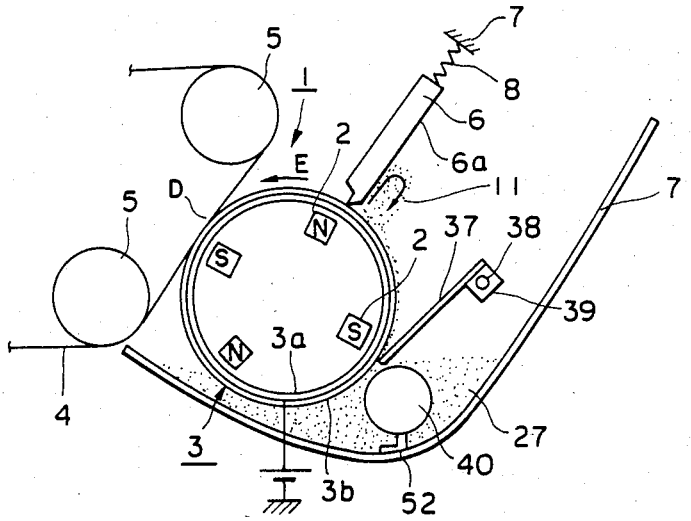
FIG. 4 is a schematic illustration showing another embodiment of the present invention.

FIG. 4 shows another embodiment of the present developing device 1 for developing an electrostatic latent image formed on the recording belt 4 by an electrically insulating and magnetically attractable toner particles. The structure of this embodiment is substantially similar to that of the previous embodiment, and identical numerals are used to indicate identical elements with omission of a repeated description. The main difference exists in the provision of a scraper blade 37 in the embodiment of FIG. 4. That is, when a thin film of toner particles uniform in thickness formed on the peripheral surface of the sleeve 3 is presented for development, those portions of the toner film that correspond to the image portion of a latent image just developed are depleted or removed at least partly, and, thus, the toner film after development is not uniform in thickness. Even if fresh toner particles are supplied to such an irregular toner film, it is rather difficult to make the toner film completely uniform in thickness again. This can be a cause of a ghost image in the following cycle of reproduction operation or of a reproduced image having non-uniform image density. The embodiment of FIG. 4 is mainly directed to obviate these disadvantages by providing the scraper blade 37.

As shown, magnetic toner particles 27 are stored in the housing 7. Toner particles having various compositions may be applied to the present invention. Typically, a single-component developer comprised of a mixture of magnetic toner particles and $SiO_2$ particles may be used. The magnetic toner particles may be formed by a mixture of a styrene family resin, dye and $Fe_3O_4$ as a magnetic material, as one example. A single-component developer may be formed only by the magnetic toner particles without $SiO_2$, but a single-component developer with $SiO_2$ is preferred in order to prevent the occurrence of the so-called background contamination.

When the sleeve 3 is driven to rotate for carrying out development, those toner particles and $SiO_2$ particles having sizes of 0.5 microns or less in the developer are started to be attracted to the peripheral surface of the rubber layer 3b of the developing sleeve 3. This could however cause the phenomenon of background contamination during developing operation. Accordingly, prior to the initiation of running the developing device 1, a developer having fine powder particles having diameters of 5 microns or less is supplied into the housing 7 of the developing device to form a film of developer having the thickness of a few microns on the rubber layer 3b of the sleeve 3. It has been found that this method is effective in preventing the occurrence of background contamination. It has also been found that background contamination can be avoided by using a spraying device to spray a developer comprised of particles having 5 microns or less to the surface of the rubber layer 3b of the sleeve 3 to form a developer layer having a desired thickness of a few microns prior to the initiation of running of the developing device 1, as different from the case in which a developer layer is allowed to be formed spontaneously as the sleeve 3 is driven to rotate.

As set forth briefly previously, once a thin film of toner particles formed uniformly in thickness on the developing sleeve 3 has been presented to development at the developing region, irregularities in thickness will appear because the toner particles forming the thin film are selectively removed. When such irregularities in thickness are formed, even if fresh toner particles are supplied to the surface of the sleeve 3 as the sleeve 3 further rotates, they cannot be eliminated completely and thus the following cycle of developing operation will be adversely affected. For example, a ghost image will be formed or non-uniformity in image density will result.

In order to cope with this, in accordance with the embodiment of the present invention shown in FIG. 4, provision is made of the scraper blade 37 at the location downstream of the developing region but upstream of the doctor blade 6. The scraper blade 37 may be formed in any desired shape by a magnetic material. For example, it may be made from a plate of magnetic material such as a SK material having the thickness of 0.05–0.1 mm. The scraper 37 should have enough resiliency or elasticity. As shown in FIG. 4, one end of the scraper blade 37 is pivoted to a pin 38 to be pivotally movable therearound. For this purpose, a support member 39 is fixedly attached to the scraper blade 37 and the support member 39 is loosely fitted into the pin 38. As the scraper blade 37 is made of a magnetic material and it is supported to be pivotal around the pin 38, the free end of the scraper blade 37 is attracted to the sleeve 3 under the influence of the attractive magnetic field emanating from the magnet 2 disposed inside of the sleeve 3. Moreover, since the scraper blade 37 is thin enough to exhibit enough deflectability, the free end portion thereof is resiliently pressed against the sleeve 3. In this connection, when one of the magnetic poles is located generally opposite to the free end of the scraper blade 37, a stronger attractive force may be obtained.

With such a structure, the developer remaining on the sleeve 3 after developing operation may be removed as scraped by the scraper blade 37. It is important, however, that the pressure or contact force between the sleeve 3 and the scraper blade 37 be so adjusted not to scrape off the film of fine developer particles initially formed on the sleeve 3. As understood, since the scraper blade 37 is formed by a magnetic material, no extra means for keeping the scraper blade 37 pressed against the sleeve 3 is required. However, also because of this, the magnetic toner particles scraped off the sleeve 3 after development tend to stagnate in the vicinity of the contact between the sleeve 3 and the scraper blade 37. In order to remove such stagnating toner particles, a scraper roll 40 is disposed in the vicinity of the scraping contact between the sleeve 3 and the scraper blade 37 in the embodiment of FIG. 4. As will be described in detail later, the scraper roll 40 is preferably driven to rotate clockwise intermittently thereby causing the scraped off toner particles to advance along the scraper blade 37 away from its free end.

Figure 5:
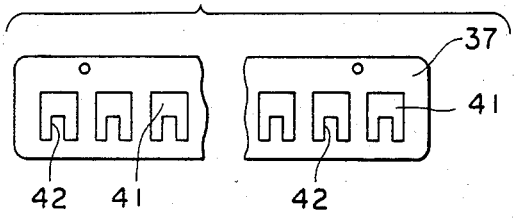
FIG. 5 is a partial front view showing one form of the scraper blade which may be employed in the developing device of FIG. 4.
Figure 6:
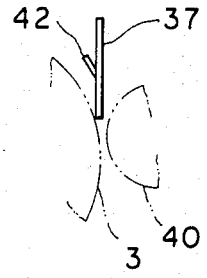
FIG. 6 is a side elevational view showing a modified structure of the scraper blade shown in FIG. 5.

One embodiment of the scraper blade 37 is shown in FIG. 5. In this embodiment, a plurality of openings 41, each having the shape of an inverted "U", are formed as arranged side by side along the lengthwise direction of the scraper blade 37. Accordingly, when the scraped off toner particles are forced to move along the scraper blade 37 by the scraper roll 40, they are partly passed through the openings 41 to be supplied to the sleeve 3. Since each of the openings 41 is formed in an inverted "U" shape, there is formed a projection 42 extending upward from the bottom edge of the opening. Provision of such a projection 42 is advantageous because debris and foreign matter such as ravelings and human hair which are present in the developer may be removed. In particular, this structure is effective in removing those ravelings and human hair of approximately 5 mm in length which could adversely affect the quality of image most. FIG. 6 shows a modification of the embodiment of FIG. 5, and, as shown, the projection 42 is bent toward one side of the scraper blade 37, or toward the sleeve 3 as shown in FIG. 6.

Figure 7:
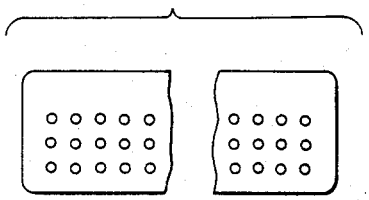
FIGS. 7–9 are partial front views showing several alternative forms of the scraper blade which may be employed in the developing device of FIG. 4.
Figure 8:
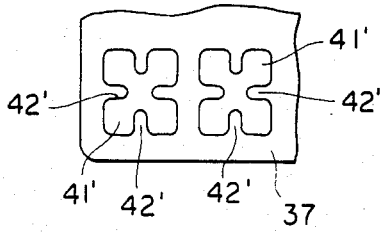
Figure 9:
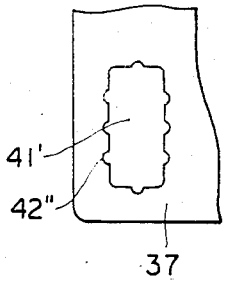

FIG. 7 shows another modification of the scraper blade 37 which is provided with a plurality of perforations. When the holes are formed by drilling, it is preferable to leave burrs on the scraper blade 37. In this case, when such a scraper blade 37 is to be mounted in the developing device, the scraper blade 37 should be oriented such that the side on which the burrs project faces the scraper roll 40. This arrangement is particularly effective in collecting ravelings. FIG. 8 shows a further embodiment of the scraper blade 37 whose openings 41' are generally square in shape. In this embodiment, there are provided four projections 42', each projecting from one side edge of the square-shaped opening 41'. Preferably, the spacing between the two opposed projections 42', 42' is set approximately in the range between 3 and 5 mm in order to collect ravelings and the like effectively. As a further modification, two or more projections may be provided at one side edge of the opening, if appropriate. FIG. 9 shows a still further modification of the scraper blade 37 which is provided with rectangularly shaped openings 41'. The side edge of each opening is indented as indicated by 42''.

Figure 10:
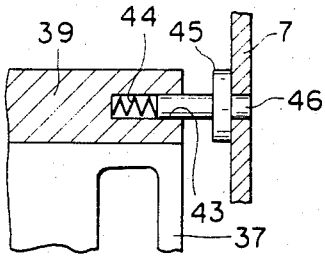
FIG. 10 is a schematic illustration showing one example of the structure for supporting a scraper blade in the developing device of FIG. 4.

FIG. 10 illustrates one example of the supporting structure for supporting the scraper blade 37 in the developing device. As illustrated, the support member 39 is fixedly attached to one side edge of the scraper blade 37 and each opposite end of the support member 39 is provided with a hole 43 in which is fitted a spring 44. And, a support pin 46, which is integrally formed with a collar 45 approximately at its center, is loosely fitted into the hole 43. The other end of the support pin 46 is also loosely fitted into a hole provided in the housing 7. Thus, the scraper blade 37 is pivotally supported to pivot around the support pin 46. It is to be noted that this structure is also advantageous in mounting the scraper blade 37 into or detaching it from the developing device. That is, it is only necessary to push the support pin 46 further into the hole 43 of the support member 39 in order to have the scraper blade 37 mounted into or detached from the developing device. As an alternative structure, however, the spring 44 may be so provided as fitted onto the support pin 46 extending between the collar 45 and the end face of the support member 39. Of course, in this alternative structure, the spring 44 must be larger in diameter.

Figure 11:
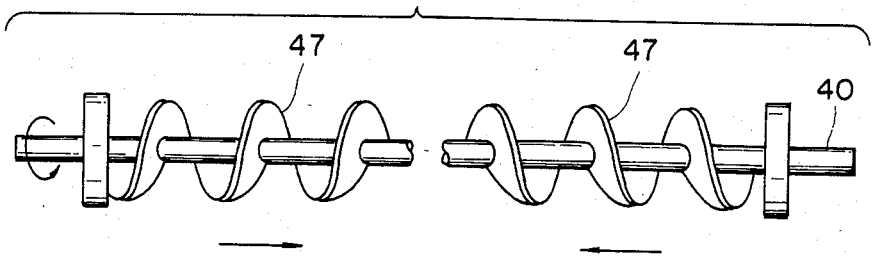
FIG. 11 is a partial front view showing a scraper roll which may be employed in the developing device of FIG. 4.
Figure 12:
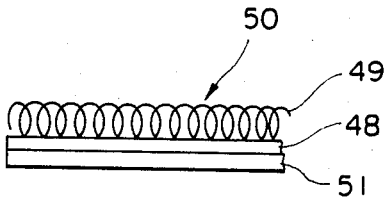
FIG. 12 is a schematic illustration showing a brush tape which may be employed in the developing device of FIG. 4.
Figure 13:
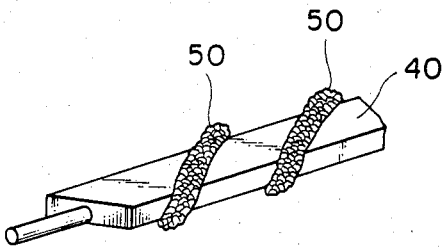
FIG. 13 is a perspective view of a modified scraper roll which may be employed in the developing device of FIG. 4.

Considering the amount of toner consumption across the width of the developing sleeve 3, it is often observed that more toner is consumed at the central portion as compared with the side portions, and this corresponds to the fact that the frequency of image formation is higher at the center than at the sides across the width of an imaging surface, such as the recording belt 4 shown in FIGS. 1 and 4, on which an electrostatic latent image is formed and developed by the developing sleeve 3. As a result, when the residual toner particles are scraped off the developing sleeve 3 by the scraper blade 37, more stagnating toner particles appear on both ends of the scraper blade 37. With this in mind, a pair of screws or helical vanes 47, 47 is fixedly mounted on the scraper roll 40 as shown in FIG. 11. In this case, the pair of screws 47 and 47 is in a mirror image relation when mounted on the scraper roll 40, and, thus, when the scraper roll 40 is driven to rotate in a predetermined direction, the scraped off toner particles are advanced toward the center from both sides. The screw 47 may be integrally formed with the scraper roll 40, if desired. Instead of the screw 47, a brush tape 50 including a base 48 having nylon loops 49, fibers, fabrics or the like fixedly provided on one surface and an adhesive tape 51 on the opposite surface may be fixedly adhered to the scraper roll 40 in a helical manner, as shown in FIG. 12. Such a brush tape 50 may be used in combination with the screw 47. As shown in FIG. 13, the scraper roll 40 may have any desired shape other than a rod as shown in FIG. 11. In the embodiment of FIG. 13, a brush tape 50 is helically and fixedly wound around a scraper roll 40 which is rectangular in cross section.

When the scraper roll 40 is structured as described above, the toner particles scraped off the sleeve 3 after development are moved toward the center of the sleeve 3 by the scraper roll 40 whereby the toner particles are also agitated. Accordingly, the scraped off toner particles are prevented from being stagnated and the toner particles as a whole are well mixed and uniform in characteristics. Furthermore, the above structure contributes to form a film of toner particles uniform in thickness as well as in property, which then contributes to form a developed image uniform in density.

As described above, after development, the toner particles remaining on the sleeve 3 are scraped off by the scraper blade 37, and these scraped off toner particles tend to become stagnated as magnetically attracted to the scraper blade 37. However, these toner particles are advanced in a predetermined direction due to rotation of the scraper roll 40, and as they are transported, they pass through the openings 41 provided in the scraper blade 37 toward the sleeve 3. On the other hand, since debris such as human hair and revelings are not influenced by a magnetic field, they are gradually brought outside of the stagnating toner particles, and if a brush tape 50 such as shown in FIG. 12 is provided on the screw 47 or the roll 40, they may be effectively collected by the brush tape 50. In order to allow to remove the thus collected debris from the brush tape 50, a cleaner member 52 is mounted on the housing 7 of the developing device of FIG. 4. Thus, the debris removed from the brush tape 50 by the cleaner member 52 may be easily transported to the outside of the housing 7 of the developing device.

Figure 14:
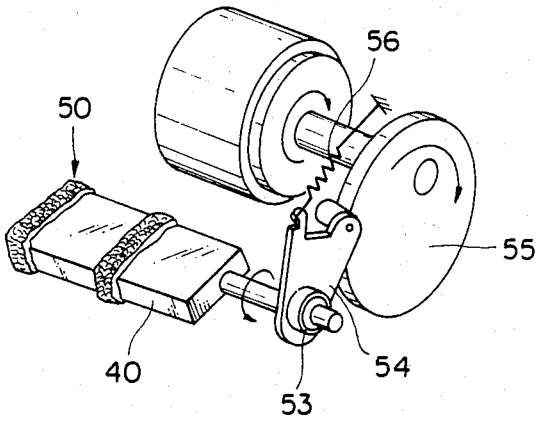
FIG. 14 is a perspective view showing one example of the structure for setting the scraper roll in operation intermittently.

Preferably, the scraper roll 40 is driven to rotate in association with the rotation of the sleeve 3 so as to prevent the occurrence of stagnating toner particles. However, it is not necessary to rotate the scraper roll 40 continuously. For example, it may be so structured that the scraper roll 40 is driven to rotate intermittently and it rotates over 30° while the sleeve 3 completes one turn. FIG. 14 shows one example of the structure for regulating the rotation of the scraper roll 40. As shown, the shaft of the scraper roll 40 is coupled to an arm plate 54 through a one-way clutch 53. The arm plate 54 is functionally a cam follower which is operatively associated with a cam 55 which is fixedly mounted on a shaft which, in turn, is associated with the driving shaft of the sleeve 3. Thus, while the developing sleeve 3 completes a single turn, the arm plate 54 is caused to turn over a predetermined angle, e.g., 30°, by the cam 55. When the arm plate 54 has been turned over a predetermined angle, it is returned to the original position by means of a spring 56; however, through the function of the one-way clutch 53, the scraper roll 40 remains unaffected and maintains the turned position. It is to be noted, however, that the intermittent driving mechanism of the scraper roll 40 is not limited to this and other mechanisms may be applied by those skilled in the art without difficulty.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A device for developing an electrophotographic latent image formed on an imaging surface using electrically insulating and magnetically attractable toner particles, comprising:

carrier means for carrying thereon said toner particles, said carrier means being driven to move along a predetermined path which passes through a developing region where said latent image is developed by said toner particles carried on said carrier means;

means for producing a magnetic field causing said toner particles to be attracted to said carrier means; and film forming means for forming a film of said toner particles on said carrier means before said carrier means enters into said developing region, said film forming means including a doctor blade which is resiliently pressed against said carrier means and said doctor blade being provided at its forward end with an edge portion having an inclined face opposite to said carrier means thereby forming a wedge shaped entrance section having an angle in the range of 15°±15° between said inclined end face and said carrier means convergent in the direction of movement of said carrier means.

2. A device of claim 1 wherein said film forming means further includes a supporting frame for supporting said doctor blade movably in the direction generally perpendicular to said carrier means and a spring for biasing said doctor blade toward said carrier means.

3. A device of claim 2 wherein said carrier means includes an electrically conductive sleeve which is supported to be driven to rotate in a predetermined direction and an elastic layer formed on the peripheral surface of said sleeve.

4. A device of claim 3 wherein said sleeve is a metal sleeve and said elastic layer is comprised of a rubber material.

5. A device of claim 4 wherein said rubber material is a silicon rubber material having resistivity of $10^5$ ohms-cm or less.

6. A device of claim 3 wherein said means for producing a magnetic field includes at least one magnet disposed inside of said sleeve.

7. A device for developing an electrostatic latent image formed on an imaging surface using electrically insulating and magnetically attractable toner particles, comprising:

carrier means for carrying thereon said toner particles, said carrier means being driven to move along a predetermined path which passes through a developing region where said latent image is developed by said toner particles carried on said carrier means;

means for producing a magnetic field for causing said toner particles to be attracted to said carrier means;

film forming means for forming a film of said toner particles on said carrier means before said carrier means enters into said developing region; and scraping means for scraping the toner particles remaining on said carrier means after passing through said developing region, said scraping means including a scraper blade which is pivotally supported at one end so that the free end of said scraper blade is resiliently pressed against said carrier means by the magnetic field produced by said means for producing a magnetic field.

8. A device of claim 7 wherein said scraper blade is provided with at least one opening which is large enough to allow passage of said toner particles therethrough.

9. A device of claim 8 wherein said scraper blade includes a projection which extends into said opening.

10. A device of claim 8 wherein the edge of said opening is indented.

11. A device of claim 7 wherein said scraper blade is provided with a number of perforations which are large enouth to allow passage of said toner particles therethrough.

12. A device of claim 7 further comprising transporting means for transporting the toner particles scraped off by said scraping means in a predetermined direction.

13. A device of claim 12 wherein said carrier means includes an electrically conductive sleeve which is supported to be driven to rotate in a predetermined direction and an elastic layer formed on the peripheral surface of said sleeve.

14. A device of claim 13 wherein said means for producing a magnetic field includes at least one magnet disposed in said sleeve.

15. A device of claim 14 wherein said transporting means includes a scraper roll for transporting said toner particles in a predetermined direction and means for rotating said scraper roll intermittently in association with the rotation of said sleeve.

16. A device of claim 15 wherein said transporting means further includes a pair of screws formed on said scraper roll, said pair of screws being arranged in a mirror image relation thereby causing said toner particles to be transported to the center from both sides when said scraper roll is driven to rotate in a predetermined direction.

* * * * *